US005585586A

United States Patent [19]

Wakuda

[11] Patent Number: 5,585,586

[45] Date of Patent: Dec. 17, 1996

[54] TEMPO SETTING APPARATUS AND PARAMETER SETTING APPARATUS FOR ELECTRONIC MUSICAL INSTRUMENT

[75] Inventor: Sadamoto Wakuda, Shizuoka-ken, Japan

[73] Assignee: Kabushiki Kaisha Kawai Gakki Seisakusho, Shizuoka-ken, Japan

[21] Appl. No.: 343,859

[22] Filed: Nov. 17, 1994

[30] Foreign Application Priority Data

| | | | |
|---|---|---|---|
| Nov. 17, 1993 | [JP] | Japan | 5-311274 |
| Nov. 25, 1993 | [JP] | Japan | 5-317505 |
| Oct. 26, 1994 | [JP] | Japan | 6-285867 |

[51] Int. Cl.[6] ..... G10H 7/00

[52] U.S. Cl. ..... 84/636; 84/DIG. 12

[58] Field of Search ..... 84/612, 636, 652, 84/668, DIG. 12

[56] References Cited

U.S. PATENT DOCUMENTS

| | | | |
|---|---|---|---|
| 4,646,609 | 3/1987 | Teruo et al. | 84/615 |
| 4,991,486 | 2/1991 | Ito et al. | 84/611 |
| 4,991,487 | 2/1991 | Yamaguchi | 84/714 |
| 5,107,745 | 4/1992 | Utsumi | 84/612 |
| 5,113,744 | 5/1992 | Tanaka et al. | 84/634 |

*Primary Examiner*—Jonathan Wysocki
*Assistant Examiner*—Marlon Fletcher

[57] ABSTRACT

A tempo setting apparatus and a parameter setting apparatus for an electronic musical instrument. The tempo setting apparatus automatically plays out a rhythm based on a set of rhythm performance data selected from plural sets of rhythm performance data stored in storage means. The tempo setting apparatus includes means for defining a standard tempo value for a rhythm to be played-out based on the selected rhythm performance data, a tempo setting device having a pointer that is movable in a predetermined range with a click at a null adjusting point, calculating means for associating the standard tempo value defined by the standard tempo defining means with an adjusting point of the tempo setting device and for calculating a new tempo value based on the standard tempo value and in accordance with an offset of the indicated position of the tempo setting device from the null adjusting point, and control means for setting the tempo value calculated by the calculating means as a tempo value for a rhythm to be automatically performed based on the predetermined rhythm performance data. The parameter setting apparatus includes a tempo defining means for defining a tempo value for a rhythm performance, a mode switch for instructing a mode change to the system set mode, and control means for accomplishing the mode change to the system set mode only if a minimum or maximum tempo value is defined by the tempo defining means when a mode change to the system set mode is instructed by the mode switch.

6 Claims, 10 Drawing Sheets

TEMPO SETTING APPARATUS AND PARAMETER SETTING APPARATUS FOR ELECTRONIC MUSICAL INSTRUMENT

BACKGROUND OF THE INVENTION AND RELATED ART

The present invention relates to a tempo setting apparatus for an electronic musical instrument, which sets the tempos of rhythms, such as an eight beat, waltz and mambo, and relates to a parameter setting apparatus for an electronic musical instrument, which sets various parameters.

Electronic musical instruments with a rhythm performance function have been developed and used. In such an electronic musical instrument, generally, plural pieces of rhythm performance data corresponding to a plurality of rhythms are previously stored in a memory so that the desired rhythm performance is automatically performed when a player selects a desired rhythm from those rhythms.

This will be explained more specifically. When a player selects a rhythm using a rhythm select switch and then operates a rhythm start switch to instruct the start of a rhythm performance, an automatic performance for the rhythm sounds (automatic rhythm performance) starts. When the automatic rhythm performance begins, a control section of the electronic musical instrument sequentially reads out rhythm performance data corresponding to the selected rhythm from the memory and sends the data piece by piece to a tone generator. The tone generator produces tone signals based on the rhythm performance data and sends the tone signals to a loudspeaker. Consequently, the rhythm sounds are produced from the loudspeaker automatically.

With such an automatic rhythm performance in progress, when the player manipulates a keyboard for a keyboard type electronic musical instrument or strings for a guitar type electronic musical instrument to instruct tone generation, the player can play a melody performance with the automatic rhythm performance on the background.

Individual rhythms have their own proper tempos (standard tempos) different from one another. It is experimentally known that whether the tempo for each rhythm is proper differs depending on the player's sense of rhythms. Conventionally, therefore, after selecting a rhythm and starting an automatic rhythm performance at its standard tempo, the player further manipulates a tempo setting device to tune the tempo based on the player's sense of rhythm.

A tempo setting apparatus is used to adjust the tempos. For example, this tempo setting apparatus comprises a tempo setting device of a rotary type such as a potentiometer and a display unit for displaying a tempo value set by this tempo setting device. For a keyboard type electronic musical instrument, the tempo setting device and the display unit are generally laid out on an operation panel located in front of a player for easier view. Accordingly, the player can operate the tempo setting device to set a desired tempo value while viewing the display unit.

With regard to, for example, a guitar type electronic musical instrument which is hung from the shoulder of a player when being played, the tempo setting device and the display unit often come to the blind position from the player during music playing. At the time of changing the tempo during music playing, it is difficult to know the standard tempo value for the rhythm, the current tempo value and the like. This hinders smooth alternation of tempos.

In the conventional tempo setting apparatus, the movable range of the tempo setting device is set to range from the minimum tempo value to the maximum tempo value. In some cases, the standard tempos value for some rhythms do not come near a tempo value corresponding to the middle point of the movable range of the tempo setting device, but come close to a tempo value corresponding to one end of that movable range. To alter the tempo value from the standard tempo value to a desired tempo value, the player should alter the position of the tempo setting device around the eccentric position corresponding to the standard tempo value and there is not much space to move the position of the tempo setting device to obtain the desired tempo value. This makes the tempo adjustment difficult.

In a conventional tempo setting apparatus comprising, for example, a tempo setting device of the rotary type, a minimum tempo value corresponding to one end of the tempo setting device and a maximum tempo value corresponding to the other end thereof are predetermined and fixed, for example, 30 and 250 beats per minute respectively, and the difference between the minimum tempo value and the maximum tempo value is large. Therefore, when a pointer of the tempo setting device alters infinitesimally, the tempo value alters significantly. Accordingly, the accuracy of setting the tempo value is not satisfactory when such a conventional tempo setting apparatus is used.

Electronic musical instruments generally have a special operation mode called "system set mode". This system set mode is used to set parameters. These parameters are used to select a timbre and the type of an acoustic effect, to indicate the degree of an acoustic effect, and the like. Parameters are normally set to an electronic musical instrument prior to music playing and the parameter setting is seldom executed during music playing. Therefore, the mode is seldom changed to the system set mode during music playing.

However, the mode may be changed from a music playing mode to the system set mode during music playing against the player's intention. To avoid such an event, a switch for changing the mode to the system set mode (hereinafter called "mode switch") is located where it is difficult for a player to touch the mode switch during music playing. The mode switch comprises, for example, two special switches which are selected from switches provided on the operation panel such as an UP/DOWN switch, a rhythm start switch, a rhythm select switch and the like. The mode is changed from the music playing mode to the system set mode only when the two switches are depressed simultaneously.

Even with the above arrangement, the mode switch may be depressed accidentally during music playing if the mode switch is located where the player has a difficulty in seeing it, as, for example, on a guitar type electronic musical instrument which is hung from the shoulder of the player. When such an event occurs, the mode is changed unexpectedly, causing the player to inevitably interrupt the music playing.

Normally, the player can confirm if an electronic musical instrument is in the system set mode by checking what is displayed on the display unit. For an electronic musical instrument without a display unit, however, the player may be late in noticing that the electronic musical instrument is set to the system set mode.

OBJECT AND SUMMARY OF THE INVENTION

Accordingly, it is a primary object of the present invention to provide a tempo setting apparatus for an electronic musical instrument which is excellent in operability and can permit a player to easily set a tempo without checking a tempo value and is both simple and inexpensive.

It is a second object of the present invention to provide a parameter setting apparatus for an electronic musical instrument which can prevent the electronic musical instrument from accidentally entering a system set mode during music playing.

To achieve the first object according to the present invention, there is provided a tempo setting apparatus for an electronic musical instrument for automatically playing-out a selected rhythm data selected from plural pieces of rhythm performance data stored in data storage means. The apparatus includes a standard tempo defining means for defining a standard tempo value for a rhythm to be played-out based on a selected rhythm performance data; a tempo setting means having a pointer that is movable in a predetermined range and having a null adjusting point at a specific position of the pointer in the movable range; calculating means for associating the standard tempo value defined by the standard tempo defining means with the null adjusting point of the tempo setting means, and for calculating a new tempo value based on the standard tempo value and in accordance with an offset of the pointer from the null adjusting point; and control means for setting the new tempo value as a tempo value for the rhythm to be automatically played-out based on the selected rhythm performance data.

According to the tempo setting apparatus for an electronic musical instrument which embodies the present invention, when a rhythm is selected, for example a standard tempo, the adjusting point of the tempo setting means is associated with the selected rhythm. A new tempo value is calculated based on the standard tempo value and in accordance with an offset of the position of the pointer of the tempo setting means. This new tempo value is set as a tempo value for the selected rhythm. Thereafter, an automatic rhythm performance is carried out with a tempo corresponding to the newly set tempo value.

A magnitude $M_p$ corresponding to the position of the pointer is outputted from the tempo setting means, or is obtained by converting an outputted value from the tempo setting means. A magnitude $M_a$ corresponding to the adjusting point is predetermined. A magnitude $M_o$ corresponding to the offset is obtained as follows.

$$M_o=M_p-M_a$$

When $M_p$ is less than $M_a$, a normalized magnitude $NM_o$ is defined as follows.

$$NM_o=M_o/(M_a-M_{min})$$

where $M_{min}$ is a minimum magnitude outputted from the tempo setting means. When $M_p$ is equal to or greater than $M_a$, a normalized magnitude $NM_o$ is defined as follows.

$$NM_o=M_o/(M_{max}-M_a)$$

where $M_{max}$ is a maximum magnitude outputted from the tempo setting means. A new tempo value T is calculated, from the following equation (1) by the calculating means, when $M_p$ is equal to or greater than $M_a$.

$$T=F(NM_o)\times G(T_{max}-T_c)+T_c \quad (1)$$

wherein $T_{max}$ is an upper limit of the tempo of the rhythm (maximum tempo value) and $T_c$ is the standard tempo value of the rhythm. A new tempo value T is calculated from the following equation (2) by the calculating means, when $M_p$ is less than $M_a$.

$$T=F(NM_o)\times G(T_c-T_{min})+T_c \quad (2)$$

wherein $T_{min}$ is a lower limit of the tempo of the rhythm (minimum tempo value). The functions F and G have arbitrary functional formulas. For example, when the functions F and G are linear functional formulas of the first degree, the equations (1) and (2) are changed to the following equations (1') and (2').

$$T=\{(M_p-M_a)/(M_{max}-M_a)\}\times(T_{max}-T_c)+T_c \quad (1')$$

$$T=\{(M_p-M_a)/(M_a-M_{min})\}\times(T_c-T_{min})+T_c \quad (2')$$

According to a first preferred embodiment of the tempo setting apparatus of the present invention, the standard tempo defining means comprises rhythm selecting means and standard tempo value storage means where standard tempo values for individual rhythm performance data are stored. Standard tempo values for rhythms to be performed based on individual pieces of rhythm performance data are previously stored in the standard tempo value storage means in association with the individual rhythm performance data. When a rhythm is selected by the rhythm selecting means, the standard tempo value for the selected rhythm is read out from the standard tempo value storage means as a new standard tempo value. This can eliminate the need for setting standard tempo values rhythm by rhythm, thus improving the operability.

According to a second preferred embodiment of the tempo setting apparatus of the present invention, the standard tempo defining means comprises rhythm selecting means and input means capable of inputting an arbitrary standard tempo value. When a rhythm is selected by the rhythm selecting means, the arbitrary standard tempo is inputted through the input means. With this feature, the player can associate the inputted arbitrary standard tempo value as a standard tempo value for each rhythm with the adjusting point of the tempo setting means, so that the player can set a standard tempo matching with the player's sense.

According to a third preferred embodiment of the tempo setting apparatus of the present invention, the adjusting point of the tempo setting means is located at the middle point or in the vicinity of the middle point of the movable range of the tempo setting means. The player can alter the tempo for the selected rhythm to the desired one by manipulating the tempo setting means at the middle point or in the vicinity of the middle point of the movable range of the tempo setting means. Unlike in the prior art, therefore, it is unnecessary to alter the tempo around an eccentric position in the movable range of the tempo setting means. This facilitates the operation to set the tempo.

According to a fourth preferred embodiment of the tempo setting apparatus of the present invention, the tempo setting means may be constituted by a rotary type potentiometer having a click at the adjusting point. Likewise, according to a fifth preferred embodiment of the tempo setting apparatus of the present invention, the tempo setting means may be constituted by a slide type potentiometer having a click at the adjusting point. These rotary type potentiometer and slide type potentiometer will be called "tempo setting devices" hereinafter.

According to the fourth or fifth preferred embodiment of the tempo setting apparatus of the present invention, a player can select a standard tempo for a currently selected rhythm based on the click position even though the player cannot see the display unit which displays the tempo value. After temporarily setting the tempo setting device to the click position to recognize the standard tempo, the player can alter the tempo to a desired one by manipulating the tempo setting device. This facilitates the tempo setting operation and can thus provide a tempo setting apparatus with an excellent operability.

According to a sixth preferred embodiment of the tempo setting apparatus of the present invention, storage means for storing a minimum tempo value and a maximum tempo value for each rhythm performance data is further provided, and the calculating means associates a range from one end of the movable range of the tempo setting device to the adjusting point with a range from the minimum tempo value to the standard tempo value, associates a range from the adjusting point to the other end of the movable range of the tempo setting device with a range from the standard tempo value to the maximum tempo value, and calculates a new tempo value in accordance with an offset of the position of the pointer of the tempo setting device from the adjusting point.

Accordingly, since the difference between the minimum tempo value and the maximum tempo value is less than that in a conventional tempo setting apparatus, the movable range of the tempo setting device is optomized for each rhythm performance. As a result, when the position of the pointer of the tempo setting device alters infinitesimally, the tempo value does not alter as much, as in the prior art device discussed previously, and the accuracy of setting the tempo value is increased to a satisfactory level.

To achieve the second object of the present invention, there is provided a parameter setting apparatus for an electronic musical instrument having a system set mode to set a parameter and which is capable of automatically playing out a rhythm based on rhythm performance data prepared previously. The apparatus includes tempo defining means for defining a tempo value for a rhythm performance, a mode switch for instructing mode change to the system set mode, and control means for accomplishing the mode change to the system set mode only if a specific tempo value is defined by the tempo defining means and the mode change to the system set mode is instructed by the mode switch.

Thus, even if a player manipulates the mode switch accidentally during the automatic rhythm performance, the electronic musical instrument does not enter the system set mode unless a specific tempo value and the mode change to the system set mode are instructed simultaneously.

According to a preferred embodiment of the parameter setting apparatus of the present invention, a minimum tempo value or a maximum tempo value defined by the tempo defining means is designated as a specific tempo value. Such a specific tempo value is not used in an automatic rhythm performance.

BRIEF DESCRIPTION OF THE DRAWINGS

FIG. 2(*a*) is a diagram showing another example of an operation panel used in the first embodiment

DESCRIPTION OF THE PREFERRED EMBODIMENTS

First Embodiment

A tempo setting apparatus for an electronic musical instrument according to a first embodiment of the present invention will be described in detail below with reference to the accompanying drawings. Since the first embodiment is assumed to be a tempo setting apparatus adapted for a guitar type electronic musical instrument, no keyboard is provided. But, the present invention is not limited to this guitar type electronic musical instrument, and may be adapted for a keyboard type electronic musical instrument or other types of electronic musical instruments. The following description is centered on the structure and operation of the section in the electronic musical instrument, which functions as the tempo setting apparatus.

Figure 1:
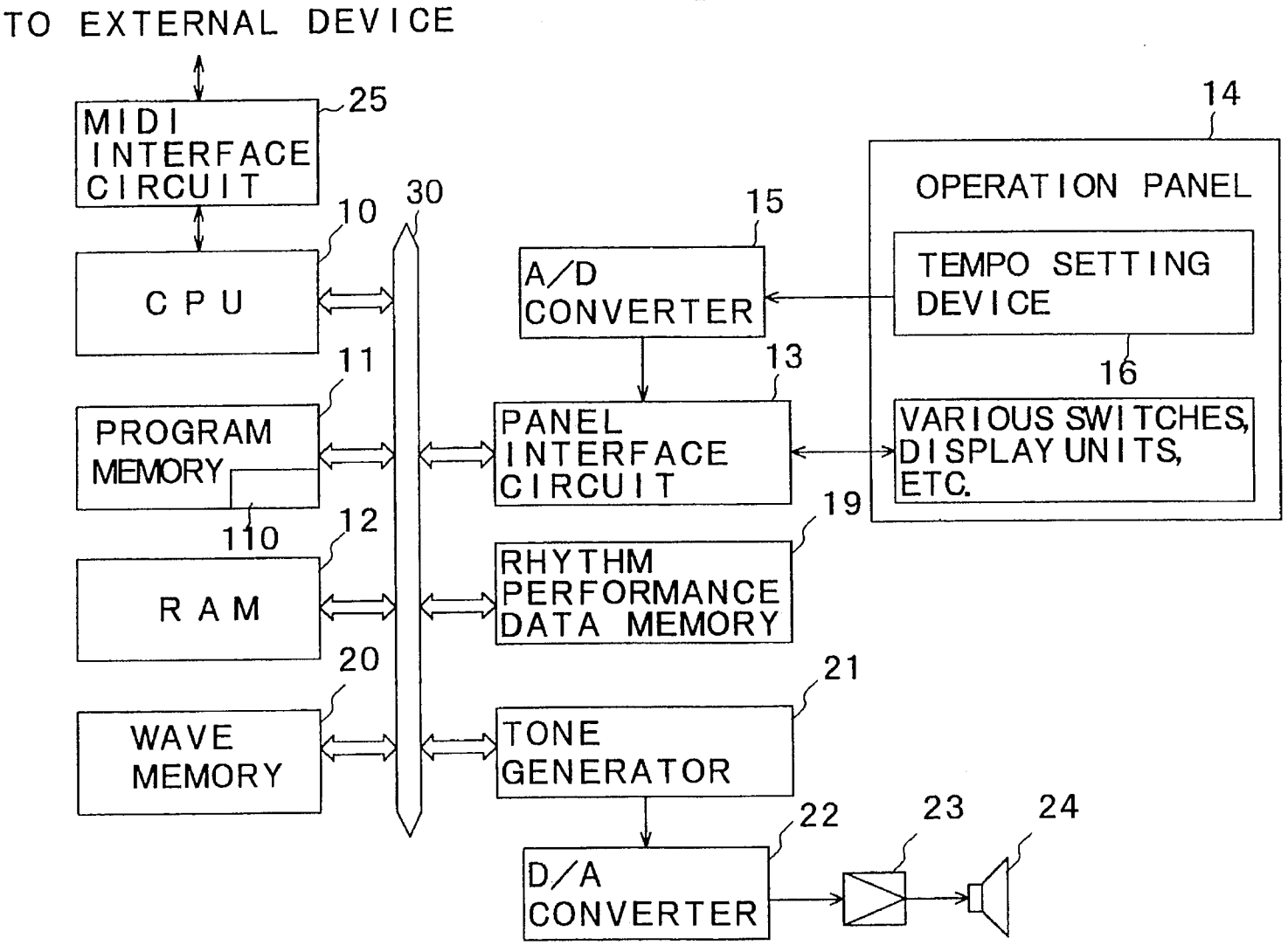
FIG. 1 is a block diagram illustrating the schematic structure of an electronic musical instrument for which a tempo setting apparatus according to a first embodiment of the present invention is adapted.

FIG. 1 presents a block diagram showing the structure of an electronic musical instrument for which the tempo setting apparatus embodying the present invention is adapted. In FIG. 1, the structure for the portion which is associated with the function of generating tones based on signals produced by plucking strings is omitted.

The electronic musical instrument for which the tempo setting apparatus of the present invention is adapted comprises a central processing unit (hereinafter called "CPU") 10, a program memory 11, a random access memory (hereinafter called "RAM") 12, a panel interface circuit 13, a rhythm performance data memory 19, a wave memory 20 and a tone generator 21, which are mutually connected by a system bus 30.

The CPU 10 performs the general control of the electronic musical instrument in accordance with a control program stored in the program memory 11. The calculating means and the control means of the tempo setting apparatus of the present invention are accomplished by this CPU 10. The detailed description of the operation of the CPU 10 will be given later. The CPU 10 includes a time counter (not shown). This time counter starts counting when the mode is set to a rhythm performance mode (which, as different from a normal performance mode, executes an automatic rhythm performance) and performs a count-up operation thereafter in a given period while the rhythm performance mode continues. In a rhythm performance process which will be discussed later, the time counter is used to detect the tone-ON timing or the tone-OFF timing.

A MIDI interface circuit 25 is connected to this CPU 10. The MIDI interface circuit 25 serves to control the exchange of MIDI data between this electronic musical instrument and an external device. The external device may be a personal computer, a sequencer, or other electronic musical instruments, which have a MIDI interface.

The program memory 11 may be constituted by a read only memory (hereinafter called "ROM"). Stored in the program memory 11 are the control program to run the CPU 10 and various types of fixed data the CPU 10 uses in various processes. The program memory 11 also has a conversion table 110 shown in Table 1. The details of the conversion table 110 will be given later.

The contents of the program memory 11 are read out by the CPU 10. More specifically, the CPU 10 reads out the control program (instructions) from the program memory 11, decodes and executes the control program, and reads out predetermined fixed data for various processes. Further, the CPU 10 uses the conversion table 110 to convert data, obtained from a tempo setting device which will be discussed later. The detailed description of the processes of the CPU 10 will be given later.

The RAM 12 is used to temporarily store various types of data at the time the CPU 10 executes the control program. Defined in the RAM 12 are various areas, such as a data buffer, a register and a flag. The CPU 10 accesses this RAM 12.

An operation panel 14 and an A/D converter 15 are connected to the panel interface circuit 13. Connected to the A/D converter 15 is a tempo setting device 16 mounted on the operation panel 14.

Figure 2:
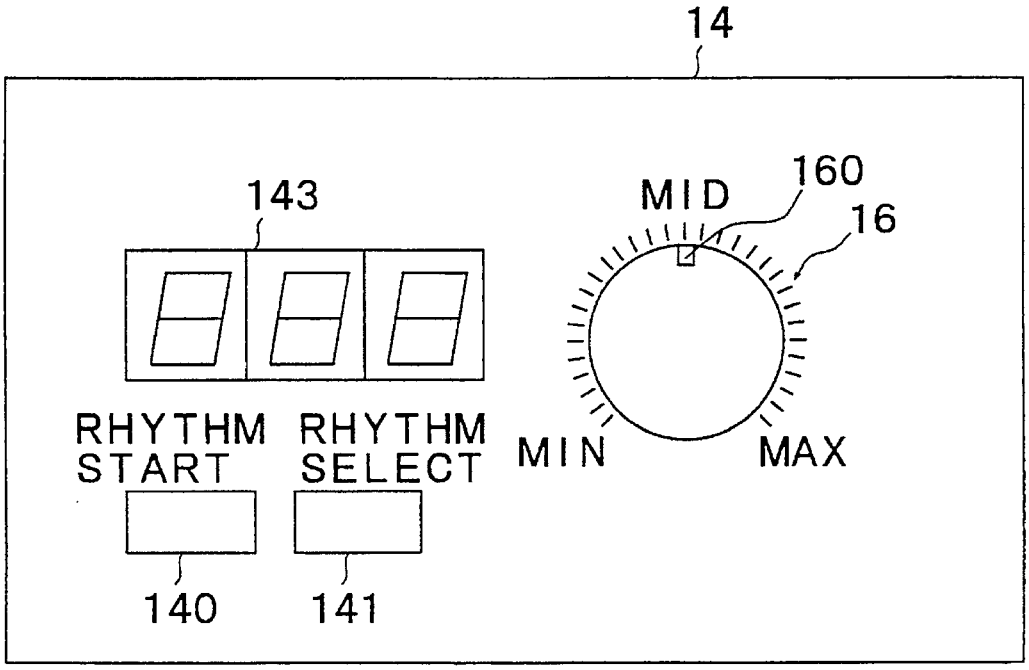
FIG. 2 is a diagram showing one example of an operation panel used in the first embodiment.
Figure 2A:
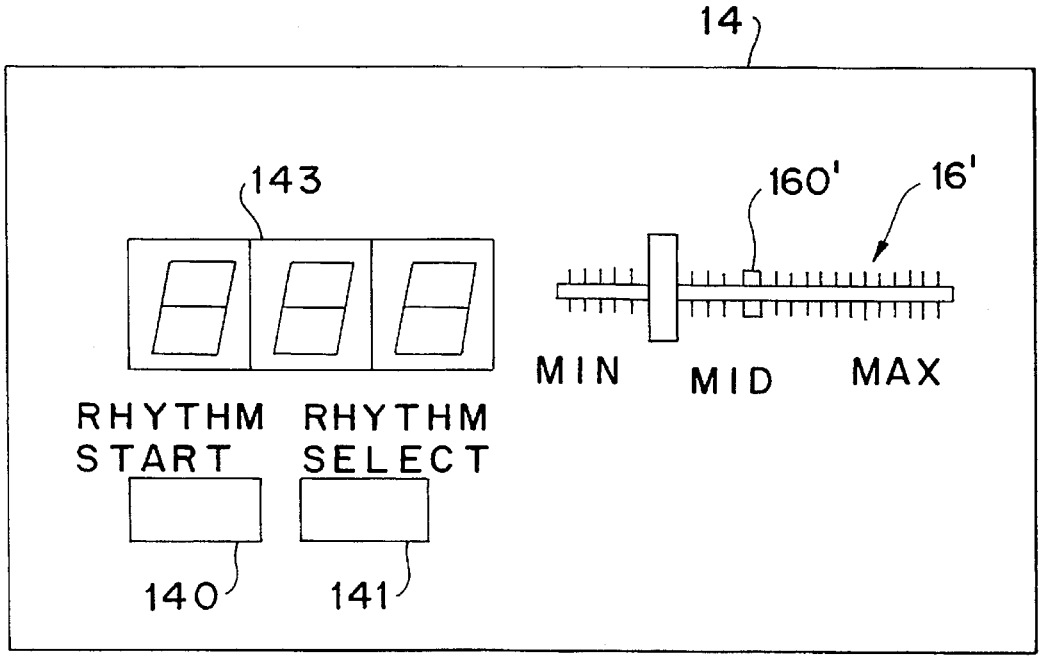

The operation panel 14 is used for a player to give various instructions to the electronic musical instrument. The operation panel 14 may have a structure as shown in FIG. 2. The operation panel 14 is provided with a rhythm start switch 140, a rhythm select switch 141, a display unit 143, and the tempo setting device 16. The rhythm select switch 141 corresponds to the rhythm selecting means. In FIG. 2, switches and any indicator which are not associated with the present invention are not illustrated.

The rhythm start switch 140 is used by the player to instruct the start or termination of a rhythm performance. Every time this rhythm start switch 140 is depressed, the rhythm performance mode and the normal performance mode are switched from one to the other alternately.

The rhythm select switch 141 is used to select one rhythm from a plurality of rhythms. Every time this rhythm select switch 141 is depressed, the rhythm number is incremented and a new rhythm associated with the resultant rhythm number is selected.

The display unit 143 has, for example, three 7-segment LED display units for two digits. This display unit 143 displays a numeral, a character, a symbol or the like in accordance with display data sent from the CPU 10. For example, the rhythm number of a new rhythm is displayed in accordance with the operation of the rhythm select switch 141 and a new tempo value is displayed in accordance with the operation of the tempo setting device 16. The display unit 143 is not limited to the 7-segment LED display unit. Instead any LCD display unit, a CRT display or any other type of display unit may be used as well.

The tempo setting device 16 is used to alter the tempo of a rhythm performance. The tempo setting device 16 may be a rotary type potentiometer which is movable in a range from the leftmost counterclockwise position (MIN) of the knob to the rightmost clockwise position (MAX) of the knob. The tempo setting device 16 has a click provided at the middle position (MID) of the movable range as an adjusting point and has a pointer 160. The tempo setting device 16 outputs an analog voltage according to the rotational position indicated by the pointer 160. In FIG. 2, for example, the minimum voltage (e.g., the ground voltage) is outputted at the position MIN, the maximum voltage (e.g., the supply voltage) is outputted at the position MAX, and an intermediate voltage between the ground voltage and the supply voltage is outputted at the position MID. The analog voltage outputted from the tempo setting device 16 corresponding to the position of the pointer 160 is sent to the A/D converter 15.

A slide type potentiometer 16' with a click at the middle point may be used as this tempo setting device 16. Alternatively, a rotary type potentiometer or a slide type potentiometer without an intermediate click may also be used as this tempo setting device 16. In this case, the middle point 160' has only to be indicated (for example, inscribed) at a predetermined position on the operation panel 14. The middle point of the tempo setting device 16 can be located at the middle point of the movable range of the tempo setting device or in the vicinity of the center of the movable range, and need not necessarily be the exact center.

A wheel which uses a rotary encoder may also be used as the tempo setting device 16. In this case, a pulse generated in accordance with the rotation of the wheel is sent directly to the panel interface circuit 13. The panel interface circuit 13 counts the number of received pulses to obtain a tempo value. This scheme advantageously eliminates the need for the A/D converter.

Returning to FIG. 1, the A/D converter 15 is of a known type which converts an analog voltage to a digital signal, and may be an A/D converting circuit constituted by an integrated circuit or an A/D converting circuit constituted by a ladder type resistor. The analog voltage inputted to this A/D converter 15 is converted to a digital signal of "00H" (the last alphabet "H" indicates a hexadecimal number; the same applies in the following description) when it is the minimum voltage, and is converted to a digital signal of "FFH" when it is the maximum voltage. When the analog voltage is neither the minimum voltage nor the maximum voltage, it is converted to a digital signal of a level lying in the range of "00H" to "FFH" according to the level of the inputted voltage corresponding to the position of the pointer 160. The digital signal outputted from the A/D converter 15 is supplied to the panel interface circuit 13.

The panel interface circuit 13 controls the exchange of data between the operation panel 14 (including the tempo setting device 16) and the CPU 10. More specifically, the panel interface circuit 13 sends a scan signal to the operation panel 14 (excluding the tempo setting device 16) in response to a panel scan command from the CPU 10, and receives a signal indicating the ON/OFF status of each switch returned from the operation panel 14 in response to this scan signal. The panel interface circuit 13 produces panel data showing the ON/OFF status of each switch by one bit, from the received signal, and sends the panel data to the CPU 10. The panel data is stored in the RAM 12 and is used to check the presence or absence of a panel event under the control of the CPU 10. (The details will be given later.)

The panel interface circuit 13 scans the A/D converter 15 to obtain a digital signal indicating the current set position of the pointer 160 of the tempo setting device 16. This digital signal is sent as tempo data to the CPU 10. This tempo data is subjected to a predetermined table conversion under the control of the CPU 10, and is stored in the RAM 12 for later use in checking the presence or absence of an event of the tempo setting device 16. The details will be given later.

The panel interface circuit 13 sends display data, sent from the CPU 10, to the display unit 143. As a result, the display unit 143 displays a numeral, character, symbol or the like.

The rhythm performance data memory 19 corresponds to the rhythm performance data storage means, the standard tempo value storage means and the storage means. The rhythm performance data memory 19 may be constituted of a ROM. Plural pieces of rhythm performance data corresponding to a plurality of rhythms are stored in this memory 19. Also stored in the rhythm performance data memory 19 are a start address table and a tempo table.

The rhythm performance data consists of, for example, three types of data for generating musical tones for three parts, such as a chord, bass and drum. The rhythm performance data for each part is prepared in a similar format (as MIDI data, for example), and includes step time data to indicate a tone-ON timing. The rhythm performance data stored in this rhythm performance data memory 19 is converted, in a rhythm performance process to be described later, into the format used by the tone generator 21.

The head addresses of rhythm performance data corresponding to the individual rhythms are stored in the start address table. When the rhythm is selected, the head address (start address) of the rhythm performance data corresponding to the newly selected rhythm is obtained from the start address table and reading-out of the rhythm performance data starts from the head address.

Stored in the tempo table in association with each rhythm performance data are a minimum tempo value and a maximum tempo value in addition to a standard tempo value (preset tempo value) which gives the standard tempo to a rhythm performance when it is executed based on rhythm performance data.

The rhythm performance data, the start address table and the tempo table may be stored in a part of the RAM 12 instead of the rhythm performance data memory 19. In this case, a floppy disk drive or a ROM card controller may be connected to the system bus 30, and the rhythm performance data, the start address table and the tempo table may be stored in a floppy disk or a ROM card whereby when the electronic musical instrument is powered on, those individual pieces of data are loaded into the RAM 12 from the floppy disk installed in the floppy disk drive or the ROM card installed in the ROM card controller.

Stored in the wave memory 20 is waveform data which has undergone pulse code modulation (PCM), for example. To achieve plural types of timbres, plural types of waveform data corresponding to the individual timbres, individual key regions and key-depression speeds are stored in this wave memory 20. When there is a tone generation instruction, this waveform data is selected and read out in accordance with the timbre designated. Then, the pitch (key region) associated with the tone generation instruction, the velocity of the tone associated with the tone generation instruction, etc.

The tone generator 21 has, for example, a plurality of oscillators. One to several oscillators are selectively assigned to each tone-ON channel to generate the tones of each part. Any oscillator assigned for tone generation reads out waveform data from the wave memory 20 in a time-division manner, and adds an envelope to the waveform data to generate a digital tone signal. The digital tone signal generated by the tone generator 21 is supplied to a D/A converter 22.

The D/A converter 22 converts the inputted digital tone signal to an analog tone signal and outputs the latter signal. The analog tone signal outputted from the D/A converter 22 is supplied to an amplifier 23. The amplifier 23 amplifies the received analog tone signal by a given amplification factor and outputs an amplified analog tone signal. The analog tone signal outputted from the amplifier 23 is sent to a loudspeaker 24, which converts the analog tone signal as an electric signal into an acoustic signal. Musical tones associated with rhythm performance data read out from the rhythm performance data memory 19 or musical tones associated with the plucking of strings (not shown) are produced from the loudspeaker 24.

Figure 4:
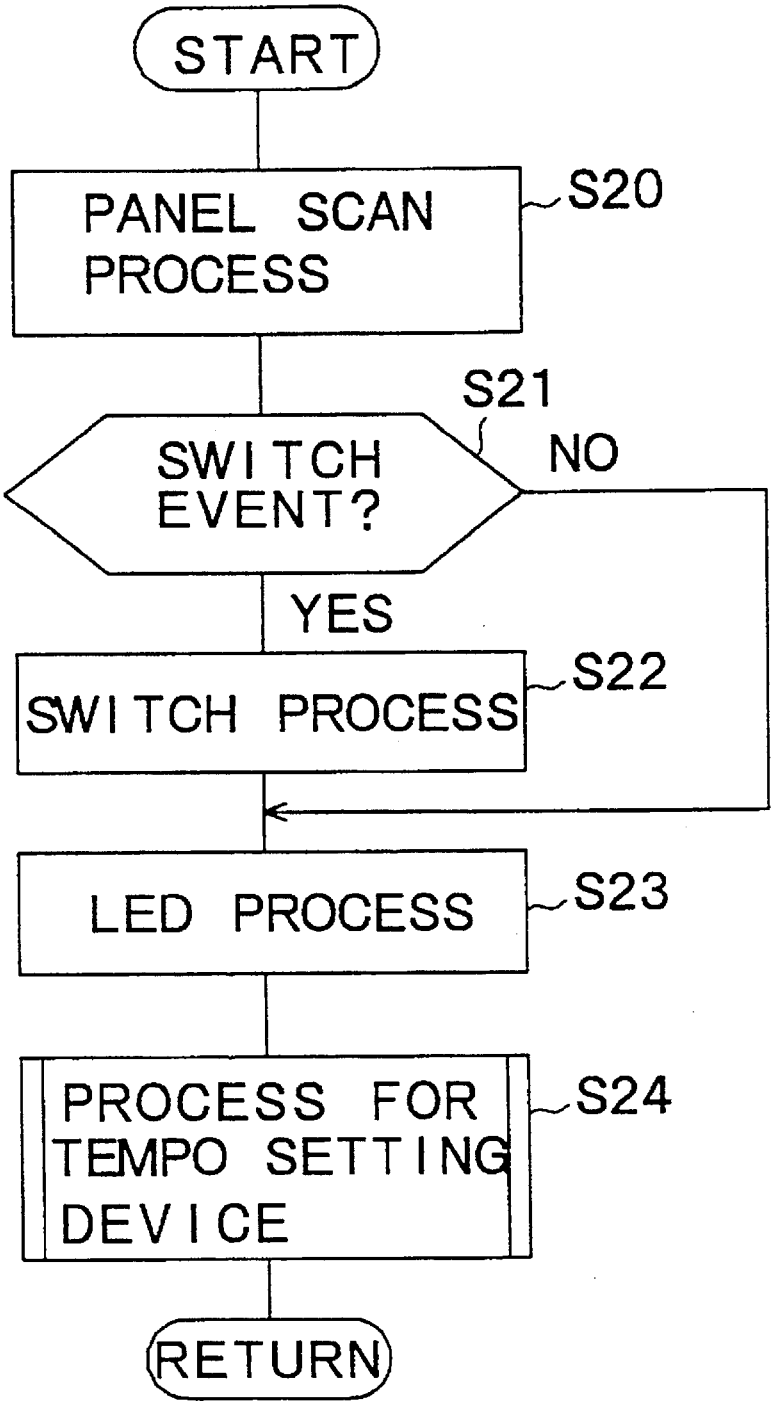
FIG. 4 is a flowchart (switch event processing routine) illustrating the operation of the first embodiment.
Figure 5:
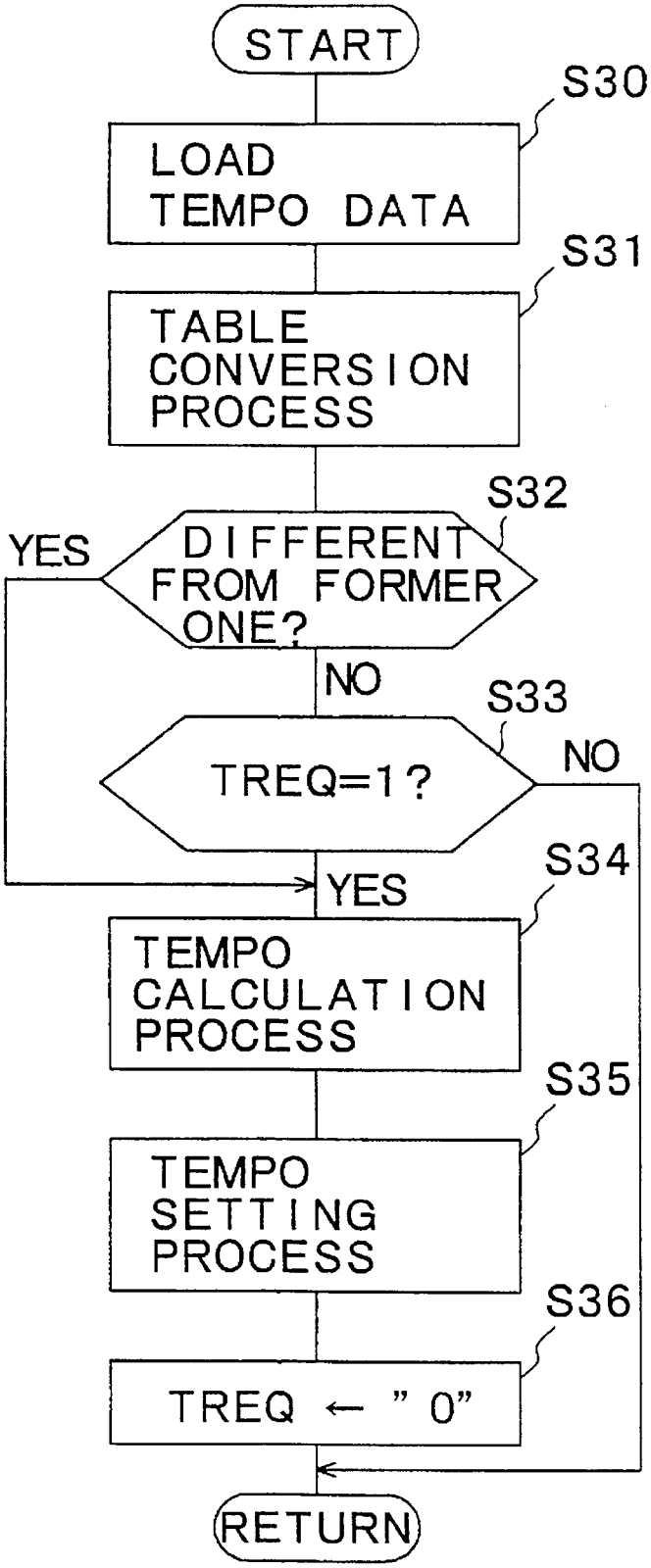
FIG. 5 is a flowchart (routine involving a tempo setting device) illustrating the operation of the first embodiment.

The operation of the electronic musical instrument, for which the thus structured tempo setting apparatus embodying the present invention is adapted, will now be described in detail with reference to flowcharts given in FIGS. 3 to 5, centering on the operation of the tempo setting apparatus. The processes in the illustrated flowcharts which will be discussed below are executed by the CPU 10.

Figure 3:
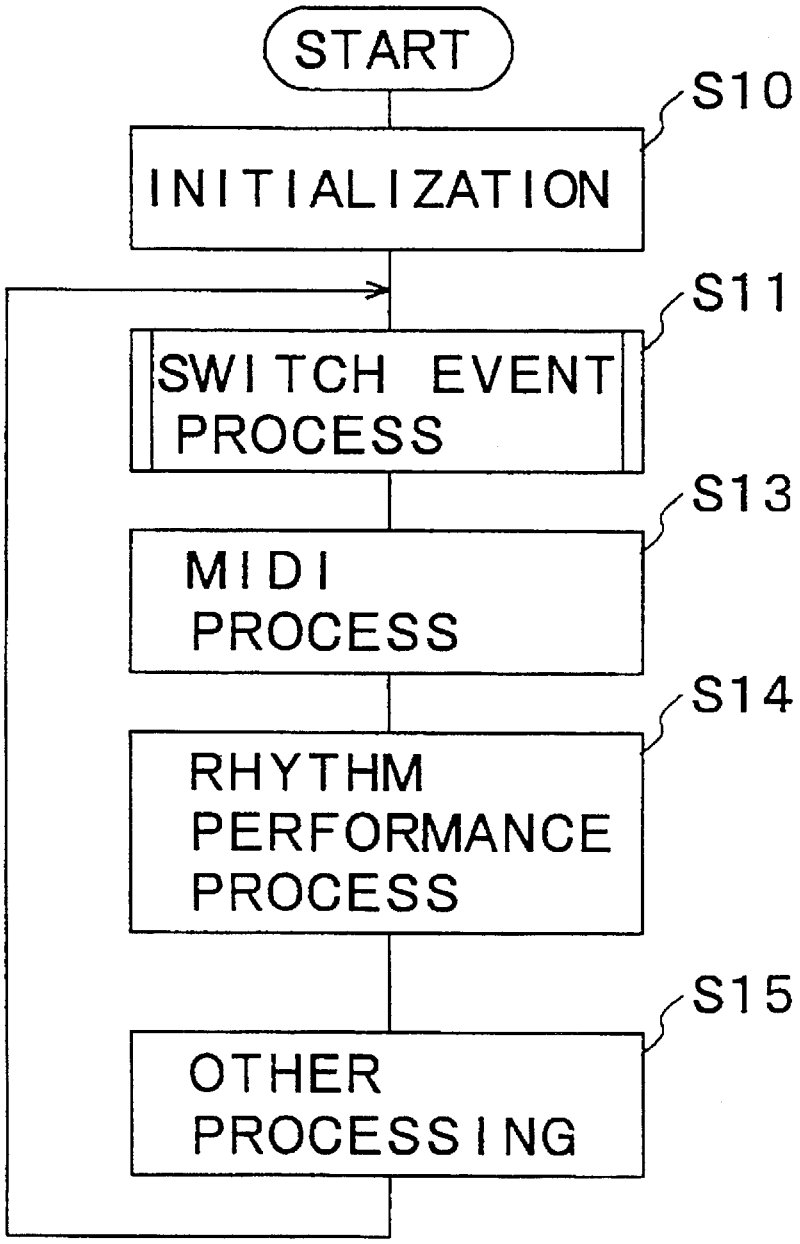
FIG. 3 is a flowchart (main routine) illustrating the operation of the first embodiment.

FIG. 3 presents the flowchart which shows the main routine for the electronic musical instrument for which the tempo setting apparatus embodying the present invention is adapted. This main routine will be invoked when the electronic musical instrument is powered on. Upon power on, initialization is executed first (step S10). In this initialization, the internal statuses of the CPU 10 are initialized and initial values are set to registers, counters, flags or the like defined in the RAM 12. In the initialization (FIG. 4), predetermined data is sent to the tone generator 21 to prevent undesirable tones from being generated at the power-on time. When the initialization is completed, a switch event process is performed (step S11). The details of this switch event process are illustrated in the flowchart in FIG. 4.

In the switch event process, a panel scan process is performed first (step S20). In this panel scan process, the CPU 10 gives a scan command to the panel interface circuit 13. In return to this scan command, the panel interface circuit 13 sends panel data (hereinafter called "new panel data") to the CPU 10. Then, the new panel data is compared with panel data previously read and already stored in the RAM 12 (hereinafter called "old panel data"), and a panel event map with the bit corresponding to the unmatched bit being set to ON is prepared.

When this panel scan process is completed, it is then checked if there is a switch event (step S21). The presence or absence of a switch event is determined by referring to the panel event map. In other words, the presence of a switch event is determined when there is one or more ON bits in the panel event map.

When it is determined that there is no switch event, the flow proceeds to step S23; otherwise, the switch process for the ON-event switch is executed (step S22). In this switch process, a process corresponding to a switch event for the rhythm start switch 140, the rhythm select switch 141 or the like is performed.

For example, when the occurrence of the ON event of the rhythm start switch 140 is determined by checking if the bit in the panel even map, which is associated with this switch 140, is ON, a rhythm performance flag is inverted. The rhythm performance flag is provided in the RAM 12 to store data indicating whether the electronic musical instrument is in a rhythm performance mode or in a normal performance mode. This accomplishes the function to alternately repeat the rhythm performance mode and the normal performance mode every time the rhythm start switch 140 is depressed.

For example, when the occurrence of the ON event of the rhythm select switch 141 is determined by checking if the bit in the panel even map, which is associated with this switch 141, is ON, a rhythm change process is performed. In the rhythm change process, the rhythm number of the rhythm newly selected by the rhythm select switch 141 is set in a rhythm number register provided in the RAM 12. Then, a standard tempo value $T_c$ corresponding to this rhythm number is obtained from the tempo table and is stored in a standard tempo value buffer in the RAM 12. This standard tempo value $T_c$ is used to compute a new tempo value in a process for the tempo setting device (step S24) which will be described later. In this rhythm change process, a tempo alternation request flag TREQ is set to "1." This tempo alternation request flag TREQ is defined in the RAM 12 and is referred to in order to determine whether the calculation of a tempo value should be performed in the process for the tempo setting device (step S24), which will be discussed later.

When the above switch process is completed, an LED process is executed (step S23). In this LED process, predetermined display data is displayed on the display unit 143. For example, the rhythm number of the rhythm newly selected by the rhythm select switch 141 is displayed. This display is achieved by sending data corresponding to the rhythm number set in the rhythm number register to the operation panel 14 via the panel interface circuit 13. The display function allows the player to know which rhythm is currently selected.

When this LED process is completed, the process for the tempo setting device is executed (step S24). The details of this process are illustrated in the flowchart in FIG. 5.

In the process for the tempo setting device, tempo data is loaded first (step S30). More specifically, the CPU 10 receives the tempo data, corresponding to the set position of the pointer 160 of the tempo setting device 16 at that time, from the panel interface circuit 13. The tempo data takes any value from "00H" to "FFH" in accordance with the set position of the pointer 160 of the tempo setting device 16.

Next, a table conversion process is executed (step S31). In this table conversion process, an influence by a voltage variation originated from other events than the manipulation of the tempo setting device 16, e.g., a variation in supply voltage, is eliminated and 256 levels of tempo data from "00H" to "FFH" are compressed to 128 levels of tempo data DT. Although the description of this embodiment will be given with reference to the case where 256 levels of tempo data are compressed to 128 levels of tempo data, the structure may be modified to compress 256 levels of tempo data to smaller tempo data than 128 levels of tempo data, or the 256 levels of tempo data may be used directly. Further, the levels of the tempo data are not limited to 256 levels. This table conversion process uses, for example, the conversion table 110 shown in Table 1.

The conversion table 110 is designed to output "00H" when the inputted value lies between "00H" and "0FH", output "40H" when the inputted value lies between "78H" and "87H", and output "7FH" when the inputted value lies between "F0H" and "FFH", so that insensitive areas are formed near the lower limit (MIN in FIG. 2) of the tempo setting device 16, the middle point (MID in FIG. 2) and the upper limit (MAX in FIG. 2). When the inputted value lies between "10H" and "77H" and between "88H" and "EFH", a value which gradually increases in accordance with the inputted value is outputted. "00H" corresponds to $M_{min}$ in the equation (1') and "7FH" corresponds to $M_{max}$ in the equation (2').

With the above structure, even if the supply voltage slightly varies with the tempo setting device 16 set near the lower limit, the middle point or the upper limit, the tempo value holds the former state. The tempo setting apparatus is therefore insusceptible to noise. According to this structure, 128 levels of tempo data are obtained by converting the tempo data and using the conversion table 110. The values of this conversion table are listed in Table 1 below. This structure has an

TABLE 1

| | CONVERSION TABLE | | | | | | | |
|---|---|---|---|---|---|---|---|---|
| INPUT | CONTENTS OF TABLE (OUTPUT) | | | | | | | |
| 000; | 000, | 000, | 000, | 000, | 000, | 000, | 000, | 000 |
| | 000, | 000, | 000, | 000, | 000, | 000, | 000, | 000 |
| 010; | 001, | 001, | 001, | 001, | 002, | 002, | 002, | 002 |
| | 003, | 003, | 004, | 004, | 005, | 005, | 006, | 006 |
| 020; | 007, | 007, | 008, | 008, | 009, | 009, | 00A, | 00A |
| | 00B, | 00B, | 00C, | 00C, | 00D, | 00D, | 00E, | 00E |
| 030; | 00F, | 00F, | 010, | 010, | 011, | 011, | 012, | 012 |
| | 013, | 014, | 015, | 016, | 017, | 018, | 019, | 01A |
| 040; | 01B, | 01C, | 01D, | 01E, | 01F, | 020, | 021, | 022 |
| | 023, | 024, | 025, | 026, | 027, | 028, | 029, | 02A |
| 050; | 02B, | 02C, | 02D, | 02E, | 02F, | 030, | 031, | 032 |
| | 033, | 033, | 034, | 034, | 035, | 035, | 036, | 036 |
| 060; | 037, | 037, | 038, | 038, | 039, | 039, | 03A, | 03A |
| | 03B, | 03B, | 03C, | 03C, | 03D, | 03D, | 03D, | 03D |
| 070; | 03E, | 03E, | 03E, | 03E | 03F, | 03F, | 03F, | 03F |
| | 040, | 040, | 040, | 040, | 040, | 040, | 040, | 040 |
| 080; | 040, | 040, | 040, | 040, | 040, | 040, | 040, | 040 |
| | 041, | 041, | 041, | 041, | 042, | 042, | 042, | 042 |
| 090; | 043, | 043, | 043, | 043, | 044, | 044, | 044, | 044 |
| | 045, | 045, | 046, | 046, | 047, | 048, | 049, | 04A |
| 0A0; | 04B, | 04C, | 04D, | 04E, | 04F, | 050, | 051, | 052 |
| | 053, | 054, | 055, | 056, | 057, | 058, | 059, | 05A |
| 0B0; | 05B, | 05C, | 05D, | 05E, | 05F, | 060, | 061, | 062 |
| | 063, | 064, | 065, | 066, | 067, | 068, | 069, | 06A |
| 0C0; | 06B, | 06C, | 06D, | 06E, | 06F, | 070, | 071, | 072 |
| | 073, | 073, | 074, | 074, | 075, | 075, | 076, | 076 |
| 0D0; | 077, | 077, | 078, | 078, | 079, | 079, | 07A, | 07A |
| | 07B, | 07B, | 07B, | 07B, | 07C, | 07C, | 07C, | 07C |
| 0E0; | 07D, | 07D, | 07D, | 07D, | 07D, | 07D, | 07D, | 07D |
| | 07E, | 07E, | 07E, | 07E, | 07E, | 07E, | 07E, | 07E |
| 0F0; | 07F, | 07F, | 07F, | 07F, | 07F, | 07F, | 07F, | 07F |
| | 07F, | 07F, | 07F, | 07F, | 07F, | 07F, | 07F, | 07F |

advantage of fast response to the manipulation of the tempo setting device 16, as compared with the case where conversion of the tempo data is accomplished by calculation.

The tempo setting apparatus, which puts more weight on the accuracy of tempo setting than the speed of a response to the manipulation of the tempo setting device 16, may be designed in such a manner that only when tempo data is received from the panel interface circuit 13 a plurality of times and has the same value, is it determined that the tempo data is what has actually been set by the tempo setting device 16. Although this structure takes a little time to execute this process, it can advantageously eliminate noise.

When the above table conversion process is completed, it is then checked whether the tempo data DT obtained through this process differs from the tempo data obtained through the previous process and stored in a predetermined area in the RAM 12 (step S32). When it is determined that both tempo data match with each other, it is considered that no event of the tempo setting device 16 has occurred, and it is then determined whether the tempo alternation request flag TREQ is "1" or if a new rhythm has been selected by the rhythm select switch 141 (step S33). When it is not determined that the tempo alternation request flag TREQ is "1," that is interpreted that no tempo alternation is needed. Accordingly, the flow returns to the routine for the switch event process from the process for the tempo setting device and then further returns to the main routine from the routine for the switch event process.

When it is determined that the tempo alternation request flag TREQ is "1," on the other hand, this is interpreted that tempo alternation is needed and the tempo setting process, beginning with step S34, is carried out. When the occurrence of the event of the tempo setting device 16 is determined in the aforementioned step S32, this likewise is interpreted that tempo alternation is needed and the tempo setting process, beginning with step S34, is carried out.

In the tempo setting process, a tempo calculation process is executed first (step S34). In the tempo calculation process, a tempo value is computed from equation (3) or (4) below, depending on whether the tempo data DT (corresponding to $M_p$ in the equations (1') and (2')) obtained in the table conversion process is equal to or greater than the data indicating the middle point (e.g., "40H" corresponding to $M_a$ in the equations (1') and (2')).

When the tempo data DT is equal to or greater than the data indicating the middle point, a new tempo value T is calculated from the following equation (3).

$$T=\{(DT-40H)/(7FH-40H)\}\times(T_{max}-T_c)+T_c \quad (3)$$

When the tempo data DT is smaller than the data indicating the middle point, a new tempo value T is calculated from the following equation (4).

$$T=\{(DT-40H)/(40H-00H)\}\times(T_c-T_{min})+T_c \quad (4)$$

In the equations (3) and (4) DT is the tempo data obtained through table conversion, $T_{max}$ is the upper limit of the tempo of the rhythm (the maximum tempo value), $T_{min}$ is the lower limit of the tempo of the rhythm (the minimum tempo value), and $T_c$ is the standard tempo value for the rhythm. The standard tempo value $T_c$, the maximum tempo value $T_{max}$ and the minimum tempo value $T_{min}$ are stored in the aforementioned tempo table for each rhythm performance data.

The equation (3) means that, when the tempo setting device 16 is set above the click position at the middle point, the range from the middle point to the upper limit position of the tempo setting device 16 is associated with the range from the standard tempo value $T_c$ for the currently selected rhythm to the maximum tempo value $T_{max}$, and a new tempo value corresponding to the offset of the position of the pointer 160 of the tempo setting device 16 from the middle point is calculated.

Likewise, the equation (4) means that, when the tempo setting device 16 is set below the click position at the middle point, the range from the lower limit position to the middle point of the tempo setting device 16 is associated with the range from the minimum tempo value $T_{min}$ for the currently selected rhythm to the standard tempo value $T_c$, and a new tempo value corresponding to the offset of the position of the pointer 160 of the tempo setting device 16 from the middle point is calculated.

The calculating means of the present invention is accomplished by the tempo calculation process in step S34 or by the process for calculating a new tempo value based on the equation (3) or (4). The calculating means of the present invention is not limited to the equation (3) or (4), but may be accomplished by a process for calculating a new tempo value using an arbitrary functional formula.

Alternatively, a conversion table where data computed from the equation (3) or (4) or based on an arbitrary functional formula, may be prepared in advance. This permits a new tempo value to be computed by referring to the conversion table in the tempo calculation process. According to this method, a new tempo value can be calculated in a single table conversion. Therefore, the computation for tempo values is simplified and the response to the manipulation of the tempo setting device 16 is made faster.

In the tempo calculation process in step S34 in this embodiment, the standard tempo value for a predetermined rhythm may be associated with the click position at the middle point of the tempo setting device 16, so that a new tempo value is calculated based on the standard tempo value and in accordance with the offset of the position of the pointer 160 of the tempo setting device 16 from the click position.

When the tempo calculation process is completed, a tempo setting process is executed next (step S35). In this tempo setting process, the tempo value T calculated in the aforementioned step S34 is set in a tempo register provided in the RAM 12. For example, a 2's complement of the tempo value T in the tempo register is set in a predetermined work counter. The content of this work counter is considered as a signless absolute value and is decremented. When the content of the work counter becomes zero, a 2's complement of the tempo value T in the tempo register is set again in the work counter. The timing at which the content of the work counter becomes zero is the timing at which a data unit constituting the selected piece of the rhythm performance data is to be read out from the rhythm performance data memory 19.

When a large value is set in the tempo register, the interval for reading out the data unit becomes smaller and the tempo becomes faster. When a small value is set in the tempo register, on the other hand, the interval for reading out the data unit becomes greater and the tempo becomes slower. In this manner, the tempo is altered in accordance with the manipulation of the tempo setting device 16.

Next, the tempo alternation request flag TREQ is cleared to "0" (step S36). When this happens, the tempo is not altered until the tempo setting device 16 is manipulated or a new rhythm is selected with the rhythm select switch 141. Thereafter, the flow returns to the routine for the switch event process from this routine for the process for the tempo setting device and then further returns to the main routine from the routine for the switch event process.

In the main routine, a MIDI process is executed next (step S13). In this MIDI process, MIDI data is exchanged with an external device, such as another electronic musical instrument, a sequencer or a computer, via the MIDI interface circuit 25. As the MIDI process is not directly associated with the present invention, its description will not be given below. A tempo may also be set by a MIDI message indicating tempo setting. More specifically, upon reception of a MIDI message indicating tempo setting, the CPU 10 sets tempo data included in the MIDI message in the tempo register in the RAM 12. The tempo is therefore altered in the same manner as done by the manipulation of the operation panel 14. As the remaining process for the MIDI message is not directly associated with the present invention, its description will be omitted.

When this MIDI process is completed, a rhythm performance process is executed next (step S14). This rhythm performance process is executed when the rhythm performance flag is "1" and when it is the time for reading out the data unit consisting of the selected piece of the rhythm performance data. Whether it is the time for reading out the data unit is determined by checking if the content of the aforementioned work counter becomes zero. When the above condition is satisfied, the data unit is read out from the rhythm performance data memory 19. When a step time value included in the rhythm performance data matches with a time value counted up by the time counter (not shown), a tone ON process or a tone OFF process is performed.

When the rhythm performance data is note-ON data, the tone ON process is carried out. In the tone ON process, for example, a waveform address, frequency data, envelope data, filter coefficient, etc. are produced based on the rhythm performance data read out from the rhythm performance data memory 19 and are then sent to the tone generator 21.

The tone generator 21 generates a digital tone signal which is, in turn, converted into an analog tone signal by the D/A converter 22. The analog tone signal is amplified by the amplifier 23 and is then sent to the loudspeaker 24. As a result, a rhythm sound is produced from the loudspeaker 24.

When the rhythm performance data is note-OFF data, on the other hand, the tone OFF process is executed. In the tone OFF process, predetermined data is sent to the tone generator 21 to stop the generation of a digital tone signal in the tone generator 21. As a result, a musical tone which is being generated is set off. Although the rhythm performance data includes data indicating timbre change, loudness alternation or the like in addition to the note-ON data or note-OFF data, such data is not directly associated with the present invention and will not thus be discussed below.

When the rhythm performance process is terminated, "other processing" is performed next (step S15). This "other processing" includes a tone generation process which is associated with the plucking of strings (not shown). Then, the flow returns to step S11 to repeat the above-described sequence of processes. When an event originating from the panel operation or the string operation during the repetitive execution of the steps S11 to S15, a process associated with that event is executed, thus accomplishing various functions of an electronic musical instrument.

According to this embodiment, as described above, when a rhythm is selected, a standard tempo value representing a standard tempo is associated with the click position at the middle point of the tempo setting device 16. When the tempo setting device 16 is manipulated, the range from the lower limit position of the tempo setting device 16 to the middle point thereof is associated with the range from the minimum tempo value to the standard tempo value, and the range from the middle point to the upper limit position of the tempo setting device 16 is associated with the range from the standard tempo value to the maximum tempo value. Under this situation, the tempo corresponding to the position of the pointer 160 of the tempo setting device 16 is calculated. More specifically, when the tempo setting device 16 is manipulated, a new tempo value corresponding to the position of the pointer 160 of the tempo setting device 16 at that time is calculated from the equation (3) or (4). The computed new tempo value is set as the tempo value for the selected rhythm. Thereafter, an automatic rhythm performance is executed at the newly set tempo.

Accordingly, the player can find out the standard tempo value for a currently selected rhythm based on the click position even though the player cannot see the display unit which displays the tempo value. As the player can manipulate the tempo setting device 16 to alter the tempo to a desired one after confirming the standard tempo, the tempo setting operation is facilitated.

Although a tempo value read from the tempo table previously prepared in the rhythm performance data memory 19 is determined as the standard tempo value for each rhythm in this embodiment, the structure may be modified to allow the player to input the standard tempo value using tempo setting device 16 on the operation panel 14 as the input means. This operation may be conducted by using, for example, the system set mode which is generally provided to set various parameters in an electronic musical instrument. For instance, the mode may be changed to the system set mode only when the rhythm start switch 140 and the rhythm select switch 141 are depressed simultaneously. In this system set mode, the mode may be changed to a tempo setting mode when the start switch, for example, is depressed, and a standard tempo value may be set by manipulating the tempo setting device 16 in this tempo setting mode. This structure allows the player to set an arbitrary tempo value as the standard tempo, thus increasing the degree of freedom in setting a tempo.

A special switch may be provided on the operation panel 14 to permit the player to select whether to determine a value read out from the tempo table as a standard tempo value, or to set the standard tempo value in the tempo setting mode described in the above manner. Since this structure increases the degree of freedom in setting a tempo, the operability is further improved.

In short, the present invention can provide a tempo setting apparatus for an electronic musical instrument, which, though being simple and inexpensive is excellent in operability and can permit a player to easily set a tempo without checking a tempo value.

Second Embodiment

A parameter setting apparatus for an electronic musical instrument according to a second embodiment of the present invention will be described in detail below with reference to the accompanying drawings. Although the second embodiment is assumed to be a parameter setting apparatus adapted for a keyboard type electronic musical instrument, the present invention is not limited to this keyboard type electronic musical instrument, and may be adapted for a guitar type electronic musical instrument or any other type. The following description is centered on the structure and operation of the section in the electronic musical instrument, which sets the electronic musical instrument to the system set mode.

Figure 6:
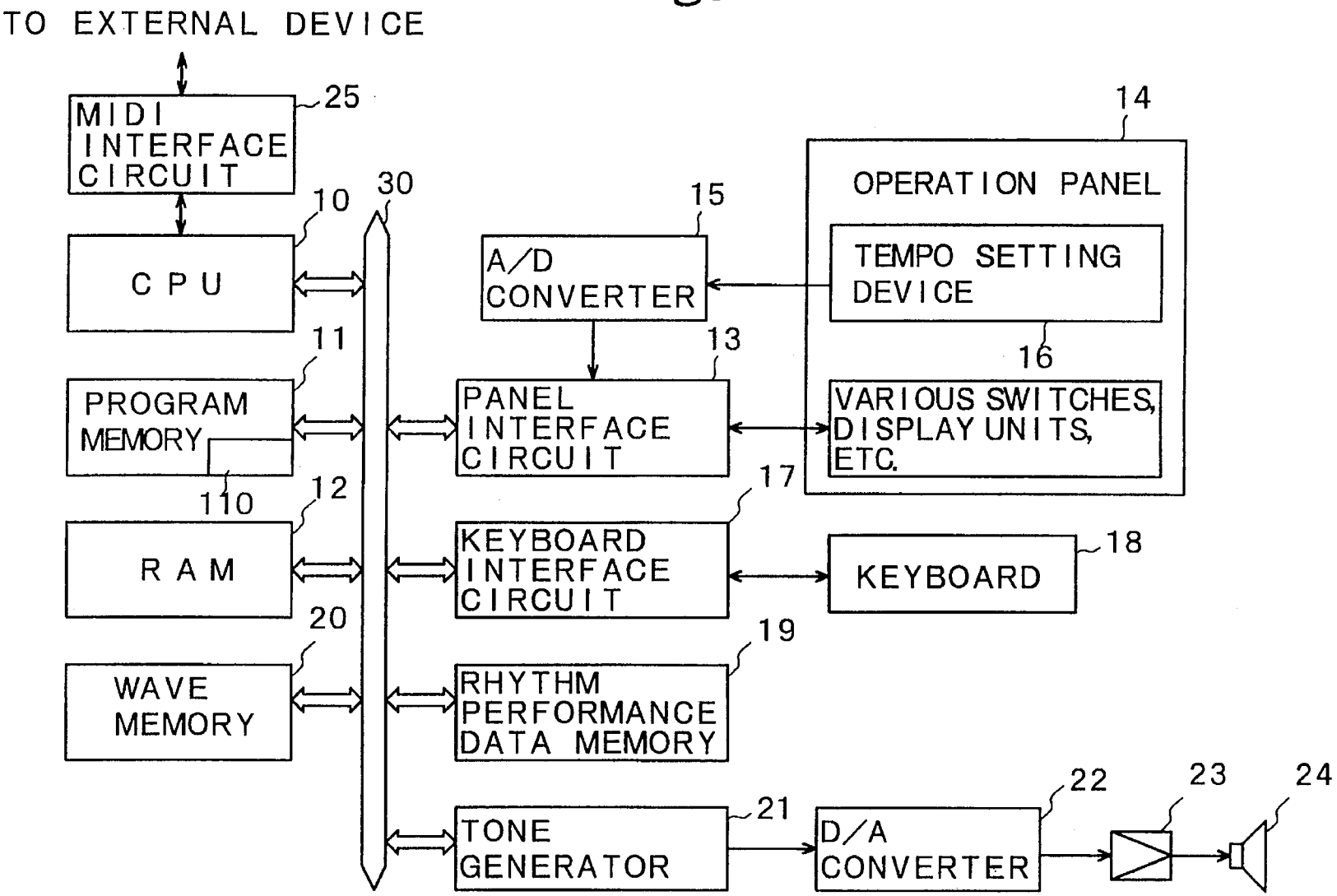
FIG. 6 is a block diagram illustrating the schematic structure of an electronic musical instrument for which a parameter setting apparatus according to a second embodiment of the present invention is adapted.

FIG. 6 presents a block diagram showing the structure of an electronic musical instrument for which the parameter setting apparatus embodying the present invention is adapted. The block diagram in FIG. 6 has a keyboard interface circuit 17 and a keyboard 18 added to the block diagram of the electronic musical instrument for which the tempo setting apparatus that has already been described with reference to FIG. 1 is adapted. Therefore, the same reference numerals are given to the corresponding or identical components.

The electronic musical instrument for which the parameter setting apparatus of the present invention is adapted comprises a CPU 10, a program memory 11, a RAM 12, a panel interface circuit 13, a keyboard interface circuit 17, a rhythm performance data memory 19, a wave memory 20 and a tone generator 21, which are mutually connected by a system bus 30.

The control means of this parameter setting apparatus is accomplished by the CPU 10 whose operation will be discussed later.

Figure 7:
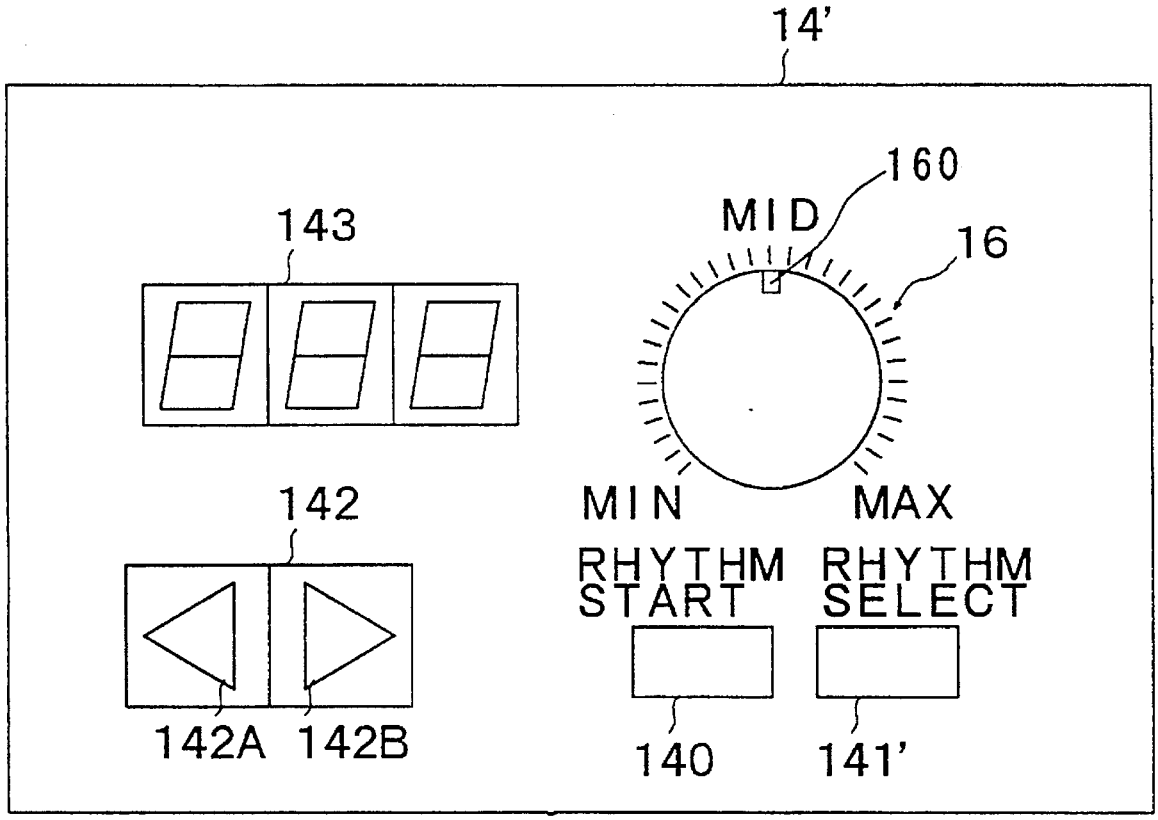
FIG. 7 is a diagram exemplifying an operation panel used in the second embodiment.

An operation panel 14' is used for a player to give various instructions to the electronic musical instrument. The operation panel 14' may have a structure as shown in FIG. 7. The operation panel 14' is the operation panel 14 of the first embodiment described with reference to FIG. 2 to which an UP/DOWN switch 142 comprising a DOWN switch 142A and an UP switch 142B is added.

The operation panel 14' is provided with a rhythm start switch 140, a rhythm select switch 141', the UP/DOWN switch 142 including the DOWN switch 142A and UP switch 142B, a tempo setting device 16 and a display unit 143. Although various other switches and indicators are provided on the operation panel 14', those switches and indicators which are not directly associated with the present invention are not illustrated in FIG. 7.

The rhythm start switch 140 is the same as the one explained in the section of the first embodiment. The rhythm select switch 141' has the same structure as the rhythm select switch 141 explained in the section of the first embodiment, but has a different function from that of the latter rhythm select switch 141. The rhythm select switch 141' is used to set the electronic musical instrument to a rhythm select mode, not to select a rhythm. In the rhythm select mode, one rhythm is selected from a plurality of rhythms. Every time the rhythm select switch 141' is depressed, the electronic musical instrument enters the rhythm select mode or returns to the former mode from the rhythm select mode. With the rhythm select mode selected by the rhythm select switch 141', when the UP/DOWN switch 142 which will be discussed later is operated, one rhythm is selected from a plurality of rhythms, such as an eight beat, waltz and mambo.

The UP/DOWN switch 142 is used to select a rhythm in combination with the rhythm select switch 141' as mentioned above, as well as is used as a mode switch to change the mode to the system set mode when the DOWN switch 142A and the UP switch 142B are simultaneously depressed. The UP/DOWN switch 142 is also used to select a timbre and an acoustic effect, to set the degree of the acoustic effect and to set various other parameters.

Although the UP/DOWN switch 142 is designed to serve as the mode switch to change the mode to the system set mode when the DOWN switch 142A and the UP switch 142B are depressed simultaneously, an exclusive switch may be provided as the mode switch or the structure may be modified in such a way that when some of the other switches (for example, the rhythm start switch 140, the rhythm select switch 141', etc.) are depressed simultaneously, the combined switches serve as the mode switch to set the system set mode.

The display unit 143 is the same as the one explained in the section of the first embodiment. When the UP/DOWN switch 142 is depressed with the rhythm select mode set by the rhythm select switch 141', for example, the display unit 143 displays the rhythm number of a rhythm selected by the manipulation of the UP/DOWN switch 142. When the tempo setting device 16 is manipulated, a tempo value according to this manipulation is displayed on the display unit 143.

The tempo setting device 16 corresponds to the tempo defining means. The tempo setting device 16 is the same as the one explained in the section of the first embodiment. The tempo defining means is not limited to the tempo setting device 16 which uses a rotary type potentiometer. For example, a slide type tempo setting device with a click at a middle point or a wheel using a rotary encoder may be used as the tempo defining means as per the first embodiment.

Alternatively, the UP/DOWN switch 142 may be used as the tempo defining means. In this case, a tempo select switch for changing the mode to a tempo set mode may be provided newly, so that after the operation mode of the electronic musical instrument is set to the tempo set mode by this tempo select switch, the DOWN switch 142A or the UP switch 142B is operated to set a tempo. The UP/DOWN switch 142 may be used to change the mode to the tempo set mode instead of the tempo select switch provided newly in the above case. In this case, the mode is changed to the system set mode by simultaneously depressing the DOWN switch 142A and the UP switch 142B, the DOWN switch 142A or the UP switch 142B is operated to set a tempo.

The keyboard 18 is connected to the keyboard interface circuit 17. The keyboard 18 has a plurality of keys to designate the pitches. The individual keys of the keyboard 18 are provided with key switches which are opened or closed in responsive to key depression or key release. A signal indicating the ON/OFF status of each key switch is sent to the keyboard interface circuit 17.

The keyboard interface circuit 17 controls the exchange of data between the keyboard 18 and the CPU 10. More specifically, the keyboard interface circuit 17 sends a scan signal to the keyboard 18 and receives a signal indicating the ON/OFF status of each key switch returned from the keyboard 18 in response to the scan signal. The keyboard interface circuit 17 produces key data showing the ON/OFF status of each key switch by one bit, from the received signal, and sends the key data to the CPU 10. The key data is stored in the RAM 12 and is used to check the presence or absence of a keyboard event under the control of the CPU 10. The details will be given later.

The rhythm performance data memory 19 has the same structure as the one explained in the section of the first embodiment. That is, the rhythm performance data memory 19 stores plural pieces of rhythm performance data corresponding to a plurality of rhythms, a start address table and a tempo table. The rhythm performance data, the start address table and the tempo table are the same as the those explained in the section of the first embodiment.

The tone generator 21 has, for example, a plurality of oscillators. One to several oscillators are assigned to each tone-ON channel to generate the musical tones associated with the depressed keys on the keyboard 18 or the musical tones for the individual parts in a rhythm performance. Any oscillator assigned for tone generation reads out waveform data from the wave memory 20 in a time-divisional manner, and adds an envelope to the waveform data to generate a digital tone signal.

A D/A converter 22 converts the inputted digital tone signal, generated by the tone generator 21, to an analog tone signal, which is in turn sent to an amplifier 23. The amplifier 23 amplifies the received analog tone signal and outputs the amplified analog tone signal to a loudspeaker 24. The loudspeaker 24 converts the analog tone signal as an electric signal into an acoustic signal, and outputs the acoustic signal. Musical tones associated with the key operation on the keyboard 18 or musical tones associated with rhythm performance data read out from the rhythm performance data memory 19 are produced from the loudspeaker 24.

Figure 9:
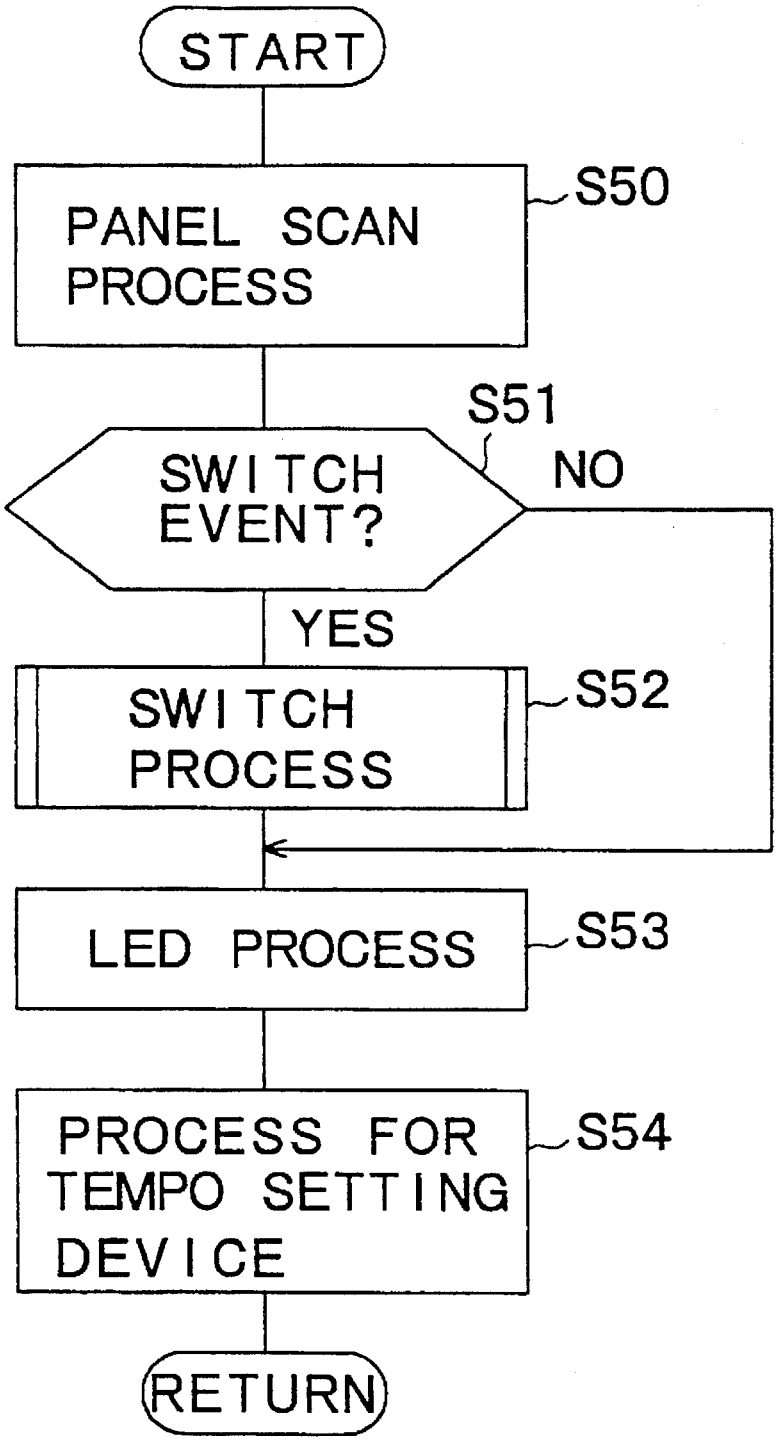
FIG. 9 is a flowchart (switch event processing routine) illustrating the operation of the second embodiment.
Figure 10:
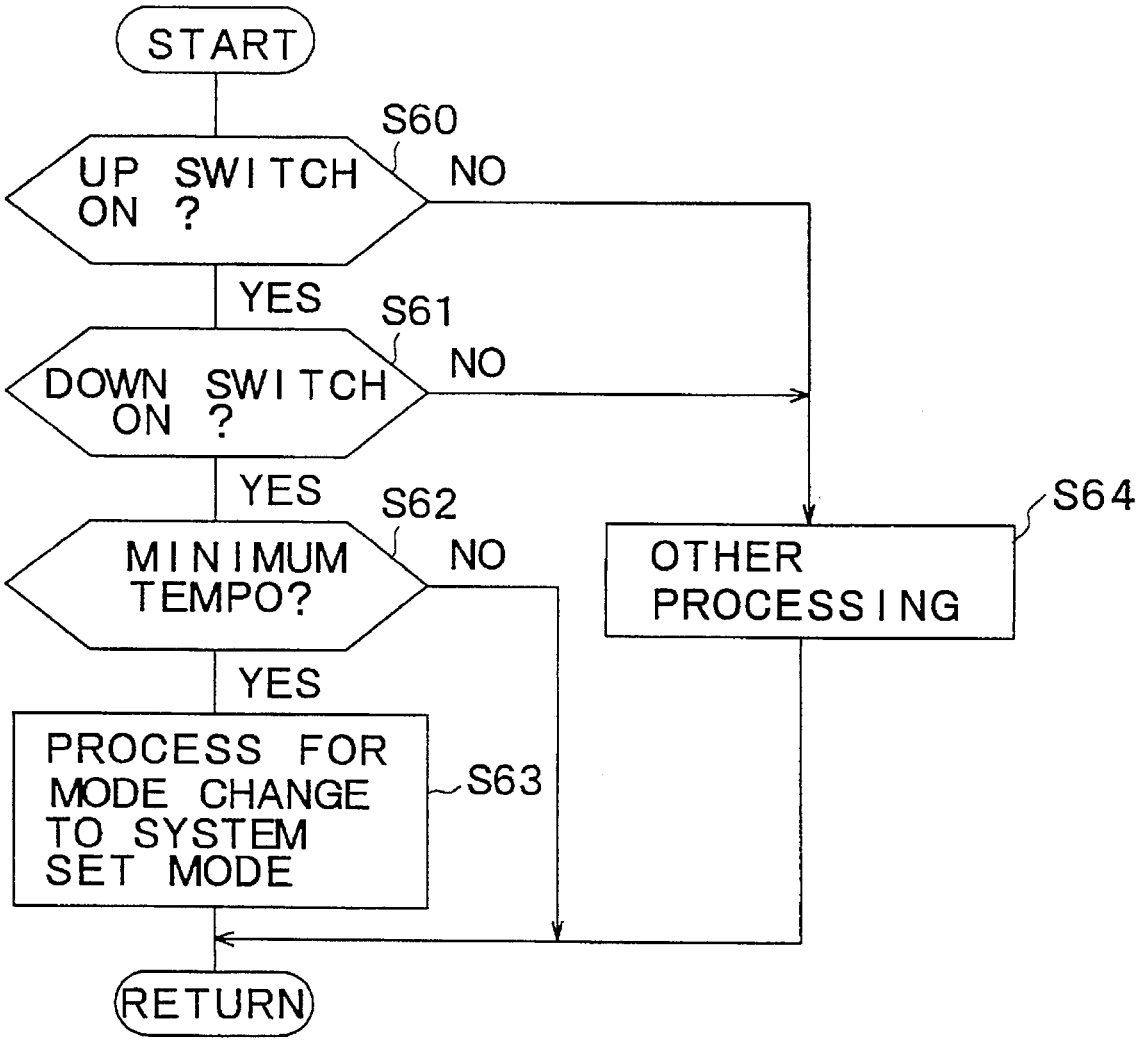
FIG. 10 is a flowchart (switch processing routine) illustrating the operation of the second embodiment.

The operation of the electronic musical instrument for which the thus structured parameter setting apparatus embodying the present invention is adapted will now be described in detail with reference to flowcharts given in FIGS. 8 to 10, centering on the operation of the parameter setting apparatus. The processes in the illustrated flowcharts are executed by the CPU 10.

Figure 8:
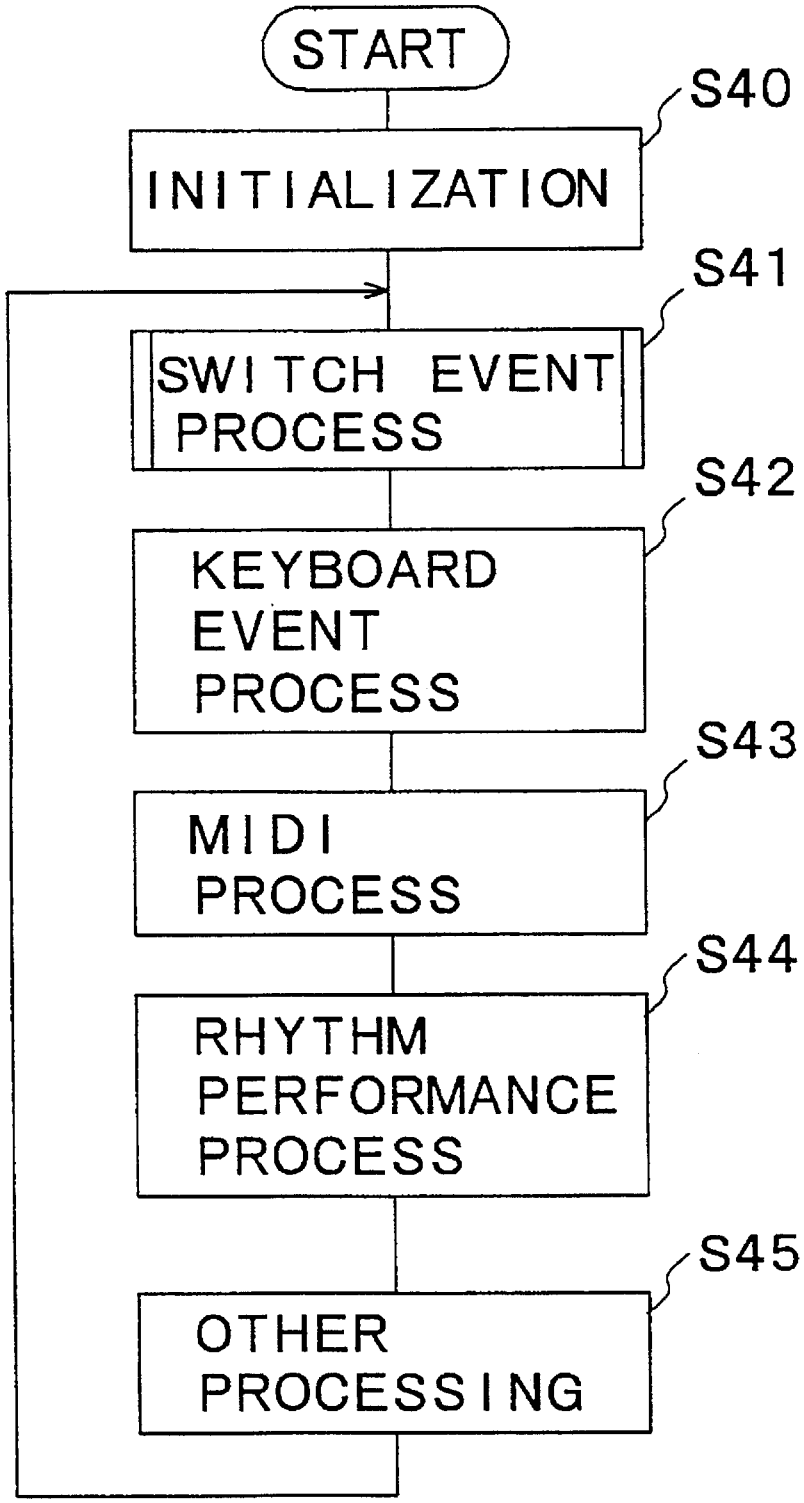
FIG. 8 is a flowchart (main routine) illustrating the operation of the second embodiment.

FIG. 8 presents the flowchart which shows the main routine for the electronic musical instrument for which the parameter setting apparatus embodying the present invention is adapted. This main routine will be invoked when the electronic musical instrument is powered on. This main routine is the same as the main routine (FIG. 3) of the first embodiment, except for an additional keyboard event process (step S42). Upon power on, initialization is executed first (step S40). The contents of the initialization are the same as those of the initialization executed in step S10 of the first embodiment. Next, a switch event process is performed (step S41). This switch event process corresponds to the process in step S11 of the first embodiment, and its details are illustrated in the flowchart in FIG. 9.

In the switch event process, a panel scan process is performed first (step S50). This process is the same as the process in step S20 of the first embodiment. It is then checked if there is a switch event (step S51). This check is performed in the same manner as the process in step S21 of the first embodiment. When it is determined that there is no switch event in this step, the flow proceeds to step S53. If there is a switch event, on the other hand, a switch process for the ON-event switch is performed (step S52). The switch process of the second embodiment corresponds to the process in step S22 of the first embodiment, and its details are illustrated in the flowchart in FIG. 10.

In this switch process, it is first checked if there is the ON event of the UP switch 142B (step S60). This check is conducted by checking if the bit in the event map which corresponds to the UP switch 142B is set ON and the bit in new panel data which corresponds to the UP switch 142B is set ON.

When it is determined that there is the ON event of the UP switch 142B, it is then checked if the DOWN switch 142A has already been set ON (step S61). This check is carried out by checking if the bit in the old panel data which corresponds to the DOWN switch 142A is set ON. The order of the steps S60 and S61 may be reversed. That is, the presence or absence of the ON event of the DOWN switch 142A may be checked first, after which it is checked if the UP switch 142B has already been set ON.

When it is determined that the DOWN switch 142A has already been set ON, the simultaneous depression of the UP switch 142B and the DOWN switch 142A is recognized. Then, it is checked if the currently set tempo value is the minimum tempo value (step S62). This process is accomplished by checking if the value set in a tempo register provided in the RAM 12, which will be discussed later, matches with the value set in a minimum tempo buffer provided in the RAM 12, which will also be discussed later.

When it is determined that the currently set tempo value is the minimum tempo value, a process to change the mode to the system set mode is performed (step S63). For example, this process permits all the musical tones being currently generated to be set off and permits the UP/DOWN switch 142 to set various parameters. In the system set mode, therefore, the player can use the UP/DOWN switch 142 to select a timbre and an acoustic effect, and to set a parameter indicating the degree of the acoustic effect.

When the mode change to the system set mode is completed, the flow returns to the routine for the switch event process from the switch process routine. When it is determined in step S62 that the tempo value is not the minimum tempo value, the process to change the mode to the system set mode is skipped and the flow returns to the routine for the switch event process from the switch process routine.

Even if the UP switch 142B and the DOWN switch 142A are depressed simultaneously, the mode change to the system set mode is not performed when the tempo value then is not the minimum tempo value. Even if the player accidentally depresses the UP switch 142B and the DOWN switch 142A at the same time during music playing (normally, the tempo value is not set to the minimum tempo value), the operation mode is not changed to the system set mode.

When it is determined in the step S60 that there is no ON event of the UP switch 142B, or when it is determined in the step S61 that the DOWN switch 142A has not been set ON yet, "other processing" is executed (step S64). In the "other processing", processes for events of various switches provided on the operation panel 14' are performed.

For instance, as described in the section of the first embodiment, the inversion of the rhythm performance flag in response to the ON event of the rhythm start switch 140 is performed, and every time the rhythm start switch 140 is depressed, the rhythm performance mode and the normal performance mode are alternately repeated.

The "other processing" includes, for example, a rhythm change process in response to the ON event of the rhythm select switch 141'. In this rhythm change process, the rhythm number of a new rhythm selected by the UP/DOWN switch 142 is set in the rhythm number register as per the first embodiment. Further, a standard tempo value $T_c$, the minimum tempo value $T_{min}$ and the maximum tempo value $T_{max}$ associated with the newly selected rhythm are read out from the tempo table and are respectively stored in the standard tempo buffer, minimum tempo buffer and maximum tempo buffer in the RAM 12. The contents of those buffers are used to compute a new tempo value in a process for the tempo setting device (step S54), which will be discussed later. As described above, the content of the minimum tempo buffer is also used to determine if the currently set tempo value is the minimum tempo value.

Although processes for other various switches provided on the operation panel 14' are performed in the "other processing", they are not directly associated with the present invention and their description will not be given below. When the "other processing" is completed, the flow returns to the routine for the switch event process from the switch process routine.

In the routine for the switch event process, an LED process is executed (step S53). This LED process corresponds to the process in step S23 of the first embodiment. In the LED process, when a new rhythm is selected by using, for example, the rhythm select switch 141' and the UP/DOWN switch 142, the rhythm number of that rhythm is displayed in the same manner as done in the first embodiment. This function allows the player to know which rhythm is currently selected.

When this LED process is completed, the process for the tempo setting device is executed (step S54). The process for the tempo setting device is the same as the process in step S24 of the first embodiment, whose details have been discussed earlier. When the process for the tempo setting device is completed, the flow returns to the main routine from the routine for the switch event process.

In the main routine, a keyboard event process is executed next (step S42) in the following manner. The CPU 10 sends a scan command to the keyboard interface circuit 17. In return to this scan command, the keyboard interface circuit 17 sends a scan signal to the keyboard 18 and receives a signal indicating the ON/OFF status of each key switch returned from the keyboard 18 in response to the scan signal. From the received signal, the keyboard interface circuit 17 produces key data indicating the ON/OFF status of each key switch by one bit (hereinafter called "new key data"). Then, the new key data is compared with key data previously read and already stored in the RAM 12 (hereinafter called "old key data"), and a key event map with the bit corresponding to the unmatched bit being set ON is prepared.

When the preparation of the key even map scan is completed, it is then checked if there is a key event by referring to the key event map. This check is accomplished by checking if there is one or more ON bits in the key event map.

If there is no ON bit in the key event map, it is confirmed that no key event has occurred and the keyboard process is terminated. If there is one or more ON bits in the key event map, on the other hand, the occurrence of a key event is confirmed, and it is then checked if the key event is an ON event or an OFF event. This check is accomplished by checking if the bit in the new key data, which corresponds to the ON-bit in the event map, is set ON or OFF.

When the key-ON event is determined, the tone ON process is carried out. In the tone ON process, the key number of a depressed key, the timbre number selected then, data indicating the strength of the key depression, etc. are converted into data the tone generator 21 can handle, such as a waveform address, frequency data, envelope data, and a filter coefficient, and those data are sent to the tone generator 21. The tone generator 21 activates an oscillator corresponding to a tone ON channel assigned to the keyboard. As a result, the oscillator reads out waveform data from the wave memory 20 and affixes an envelope to this waveform data to produce a digital tone signal. The digital tone signal is converted into an analog tone signal by the D/A converter 22. The analog tone signal is amplified by a predetermined amplification factor by the amplifier 23 and the amplified analog tone signal is sent to the loudspeaker 24. As a result, a musical tone corresponding to the depressed key is produced from the loudspeaker 24. When the occurrence of the key-OFF event is determined, on the other hand, the tone OFF process is executed. More specifically, the oscillator associated with the released key is searched and predetermined data is sent to that oscillator to stop tone generation.

When the keyboard event process is terminated, a MIDI process is executed next (step S43). The MIDI process is the same as the process in step S13 of the first embodiment. When the MIDI process is terminated, a rhythm performance process is performed next (step S44). This rhythm performance process is the same as the process in step S14 of the first embodiment.

When the rhythm performance process is completed, "other processing" is performed next (step S45). This "other processing" includes a timbre change process which is invoked by the depression of a foot pedal (not shown). Then, the flow returns to step S41 to repeat the above-described sequence of processes. When an event originating from the panel operation or the keyboard operation during the repetitive execution of the steps S41 to S45, a process associated with that event is executed, thus accomplishing various functions of an electronic musical instrument.

According to this embodiment, as described above, at the time the DOWN switch 142A and the UP switch 142B are simultaneously depressed to set the system set mode, this mode change is accomplished only when the tempo value indicated by the tempo setting device 16 then is a minimum tempo value for the rhythm to be performed.

Under music playing, there is little chance that a rhythm is performed at the minimum tempo, but a rhythm performance is often executed at a tempo around the standard tempo for the rhythm. Under music playing or when a rhythm performance is carried out at a tempo other than the minimum tempo, therefore, even if the player accidentally depresses the DOWN switch 142A and the UP switch 142B at the same time, the electronic musical instrument is not set to the system set mode and is prevented from entering this system set mode unintentionally.

This embodiment is designed in such a way that the mode is set to the system set mode only when the DOWN switch 142A and the UP switch 142B are simultaneously depressed with the minimum tempo value set by the tempo setting device 16. This embodiment may however be modified in such a way that the mode is set to the system set mode only when the DOWN switch 142A and the UP switch 142B are simultaneously depressed with the maximum tempo value, or only when the DOWN switch 142A and the UP switch 142B are simultaneously depressed with either the minimum tempo value or the maximum tempo value. In this case, the modification has the same function and advantages as the second embodiment.

If a return-to-center type wheel or a tempo setting device having a click at the middle point is used as the tempo setting device 16, the structure may be modified to change the mode to the system set mode when the DOWN switch 142A and the UP switch 142B are depressed simultaneously with the tempo setting device set to the middle point.

Although the mode change to the system set mode is allowed only when the tempo is set to a specific tempo in the above embodiment, this embodiment may be modified to accomplish this mode change only when another musical element, such as loudness, is set to the minimum value. Under music playing, the loudness is not set to the minimum value. The modification therefore has the same function and advantages as the second embodiment.

The above embodiment is designed to change the mode to the system set mode when the mode switch is manipulated with the tempo setting device 16 set to the maximum tempo value or the minimum tempo value. This embodiment may however be modified in such a manner that the mode change to the system set mode is allowed when the tempo setting device 16 is to be set to the maximum tempo value or the minimum tempo value within a predetermined period of time after the manipulation of the mode switch. This modification also has the same function and advantages as the second embodiment.

In short, the present invention can provide an electronic musical instrument, which can be prevented from accidentally entering the system set mode during the music playing.

What is claimed is:

1. A tempo setting apparatus for an electronic musical instrument for automatically playing-out a rhythm based on a selected one from among plural sets of rhythm performance data stored in data storage means, said apparatus comprising:

standard tempo defining means for defining a standard tempo value for a rhythm to be played-out based on a selected set of rhythm performance data;

tempo setting means having a pointer that is movable within a predetermined range, said tempo setting means having a null adjusting point at a specific position of said pointer in said movable range;

calculating means for associating said standard tempo value defined by said standard tempo defining means with said null adjusting point of said tempo setting means, and for calculating a new tempo value based on said standard tempo value and in accordance with an offset in position of the pointer from said null adjusting point; and control means for setting said new tempo value calculated by said calculating means as a tempo value for a rhythm to be automatically played-out based on the selected rhythm performance data;

wherein said tempo setting means is a rotary type potentiometer having a click when the pointer is positioned at said null adjusting point.

2. A tempo setting apparatus for an electronic musical instrument for automatically playing-out a rhythm based on a selected one from among plural sets of rhythm performance data stored in data storage means, said apparatus comprising:

standard tempo defining means for defining a standard tempo value for a rhythm to be played-out based on a selected set of rhythm performance data;

tempo setting means having a pointer that is movable within a predetermined range, said tempo setting means having a null adjusting point at a specific position of said pointer in said movable range;

calculating means for associating said standard tempo value defined by said standard tempo defining means with said null adjusting point of said tempo setting means, and for calculating a new tempo value based on said standard tempo value and in accordance with an offset in position of the pointer from said null adjusting point; and control means for setting said new tempo value calculated by said calculating means as a tempo value for a rhythm to be automatically played-out based on the selected rhythm performance data;

wherein said tempo setting means is a slide type potentiometer having a click when the pointer is positioned at said null adjusting point.

3. A tempo setting apparatus for an electronic musical instrument for automatically playing-out a rhythm based on a selected one from among plural sets of rhythm performance data stored in data storage means, said apparatus comprising:

standard tempo defining means for defining a standard tempo value for a rhythm to be played-out based on a selected set of rhythm performance data;

tempo setting means having a pointer that is movable within a predetermined range, said tempo setting means having a null adjusting point at a specific position of said pointer in said movable range;

calculating means for associating said standard tempo value defined by said standard tempo defining means with said null adjusting point of said tempo setting means, and for calculating a new tempo value based on said standard tempo value and in accordance with an offset in position of the pointer from said null adjusting point; and control means for setting said new tempo value calculated by said calculating means as a tempo value for a rhythm to be automatically played-out based on the selected rhythm performance data;

wherein said data storage means stores a minimum tempo value and a maximum tempo value for each set of rhythm performance data stored in the data storage means, and wherein said calculating means associates a range from one end of said movable range of said tempo setting means to said null adjusting point with a range from said minimum tempo value to said standard tempo value, associates a range from said null adjusting point to another end of said movable range of said tempo setting means with a range from said standard tempo value to said maximum tempo value, and calculates a new tempo value in accordance with the offset of said pointer from said null adjusting point.

4. The tempo setting apparatus according to claim 3, wherein said tempo setting means is a rotary type potentiometer having a click when the pointer is positioned at said null adjusting point.

5. The tempo setting apparatus according to claim 3, wherein said tempo setting means is a slide type potentiometer having a click when the pointer is positioned at said null adjusting point.

6. A parameter setting apparatus for an electronic musical instrument having a system set mode to set a parameter and capable of automatically playing-out a rhythm based on previously stored rhythm performance data, said apparatus comprising:

tempo defining means for defining a tempo value for a rhythm to be played-out;

a mode switch for instructing a mode change to said system set mode; and control means for accomplishing said mode change to said system set mode, only if a minimum tempo value or a maximum tempo value is defined by said tempo defining means when a mode change to said system set mode is instructed by said mode switch.

* * * * *